United States Patent [19]

Richter

[11] 4,146,947

[45] Apr. 3, 1979

[54] SPREADER ROLL

[75] Inventor: Friedrich Richter, Bielefeld, Fed. Rep. of Germany

[73] Assignee: Hermann Windel GmbH & Co., Bielefeld, Fed. Rep. of Germany

[21] Appl. No.: 815,501

[22] Filed: Jul. 14, 1977

[30] Foreign Application Priority Data

Jul. 14, 1976 [DE] Fed. Rep. of Germany ..... 7622138

[51] Int. Cl.[2] ..... D06C 3/06

[52] U.S. Cl. ..... 26/104; 198/826

[58] Field of Search ..... 26/101, 102, 103, 104; 29/116 AD; 198/824, 826; 162/271

[56] References Cited

U.S. PATENT DOCUMENTS

| | | | |
|---|---|---|---|
| 349,139 | 9/1886 | Birch | 26/103 |
| 950,617 | 3/1910 | Fielden | 26/101 |
| 1,776,382 | 9/1930 | Farrell | 26/101 |
| 2,771,658 | 11/1956 | Morrill | 26/104 |
| 3,161,125 | 12/1964 | Hornbostel | 198/824 X |
| 3,199,663 | 8/1965 | Baechli | 198/824 |
| 3,831,239 | 8/1974 | Hoff et al. | 26/101 X |

FOREIGN PATENT DOCUMENTS

| | | | |
|---|---|---|---|
| 147154 | 7/1952 | Australia | 198/824 |

*Primary Examiner*—Robert Mackey

*Attorney, Agent, or Firm*—Peter K. Kontler

[57] ABSTRACT

A spreader roll for webs of textile material has a flexible shaft whose end portions rotate in or with pairs of bearings installed in sleeves which are pivotable about horizontal axes to thereby change the curvature of the shaft and/or slidable with respect to stationary holders to thereby effect or change lateral deflection of the shaft. The shaft is surrounded by and fixed to annular supporting elements which are surrounded by an elastic hose whose ends are sealed against entry of atmospheric air.

6 Claims, 2 Drawing Figures

SPREADER ROLL

BACKGROUND OF THE INVENTION

The present invention relates to improvements in so-called spreader rolls for webs of textile material or the like. More particularly, the invention relates to improvements in spreader rolls of the type wherein a flexible tubular envelope (preferably a hose made of elastomeric material) surrounds an arcuate supporting structure which is rotated by or rotates the envelope.

The tubular envelopes (hereinafter called hoses) of conventional spreader rolls are slipped onto a set or row of annular supporting elements in the form of rollers or wheels which rotate on a rigid stationary arcuate shaft. Antifriction bearings are installed between the supporting elements and the shaft to insure that the supporting elements encounter little resistance to rotation with respect to the shaft regardless of whether the supporting elements receive torque from a web of textile material or the like or from a separate drive. The end portions of the hose are secured to the outermost supporting elements.

The just described conventional spreader rolls exhibit a number of serious drawbacks. Thus, the initial cost is very high because at least one antifriction bearing (e.g., a ball bearing) must be provided for each and every supporting element. Since the shaft is normally long, the number of supporting elements and antifriction bearings is quite substantial. Secondly, the transmission of torque from a discrete drive to the supporting elements presents many problems because the shaft is stationary and, therefore, the output means of the drive can transmit torque only to one or both outermost supporting elements (the remaining supporting elements are fully confined in the interior of the hose). In addition, the maintenance cost of conventional spreader rolls is extremely high because the entire roll must be dismantled whenever it becomes necessary to gain access to one or moe supporting elemments and/or antifriction bearings. When the temperature in the interior of the hose deviates from the temperature of the surrounding air, the roll sucks air and moisture into the hose. The condensate attacks the antifriction bearings so that the bearings must be inspected and replaced at frequent intervals. In order to gain access to the bearings, workmen must disengage the ends of the hose from the nearest supporting elements, remove the hose, and thereupon remove one or more supporting elements and their bearings if the damaged bearing is not interposed between the shaft and one of the outermost supporting elements. Penetration of air and moisture into the interior of the hose cannot be prevented because the shaft is stationary and, therefore, each and every supporting element must be free to rotate on the shaft.

OBJECTS AND SUMMARY OF THE INVENTION

An object of the invention is to provide a spreader roll which is simpler, less expensive and more reliable than heretofore known spreader rolls.

Another object of the invention is to provide a spreader roll whose maintenance cost is a small fraction of the maintenance cost of conventional spreader rolls.

A further object of the invention is to provide a spreader roll wherein the interior of the hose can be airtightly sealed from the surrounding atmosphere in a simple and inexpensive way.

An additional object of the invention is to provide a spreader roll wherein the supporting elements for the hose need not rotate with respect to the shaft.

An ancillary object of the invention is to provide novel and improved supports for the end portions of the shaft in the above outlined spreader roll.

A further object of the invention is to provide a spreader roll wherein the curvature of the shaft can be adjusted in a simple and time-saving manner, also at such times when the roll is in actual use.

Another object of the invention is to provide novel and improved means for effecting and/or adjusting the extent of lateral deflection of one or more selected portions of the shaft.

An additional object of the invention is to provide novel supporting elements for the hose of the improved spreader roll.

The invention is embodied in a spreader roll which comprises an elongated arcuate flexible shaft having an intermediate portion and two end portions (the shaft may consist of synthetic plastic material which is reinforced by glass fibers or the like and can be mounted in such a way that its intermediate portion is located at a level above the end portions), support means rotatably mounting the end portions of the shaft (i.e., the shaft can rotate about its axis and is thereby continuously flexed), and a plurality of annular supporting elements surrounding and rotatable with the intermediate portion of the shaft (such supporting elements, or at least some of the supporting elements, may consist of a suitable synthetic plastic material and each thereof can be fixedly secured to the shaft).

The spreader roll preferably further comprises a flexible envelope, most preferably an elastic hose, which surrounds the supporting elements and whose open end portions are airtightly secured to the shaft, e.g., by way of pairs of clamping members which are secured to the respective outermost supporting members and/or directly to the flexible shaft.

The support means preferably comprises a discrete sleeve for each end portion of the shaft and bearing means (e.g., a plurality of coaxial antifriction ball bearings) interposed between each sleeve and the respective end portion of the shaft.

The spreader roll preferably further comprises means for adjusting the orientation of the shaft with respect to portions of or the entire support means. Such orientation adjusting means may include means for changing the curvature of the shaft and/or means for effecting and/or changing lateral deflection of the shaft.

The novel features which are considered as characteristic of the invention are set forth in particular in the appended claims. The improved spreader roll itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
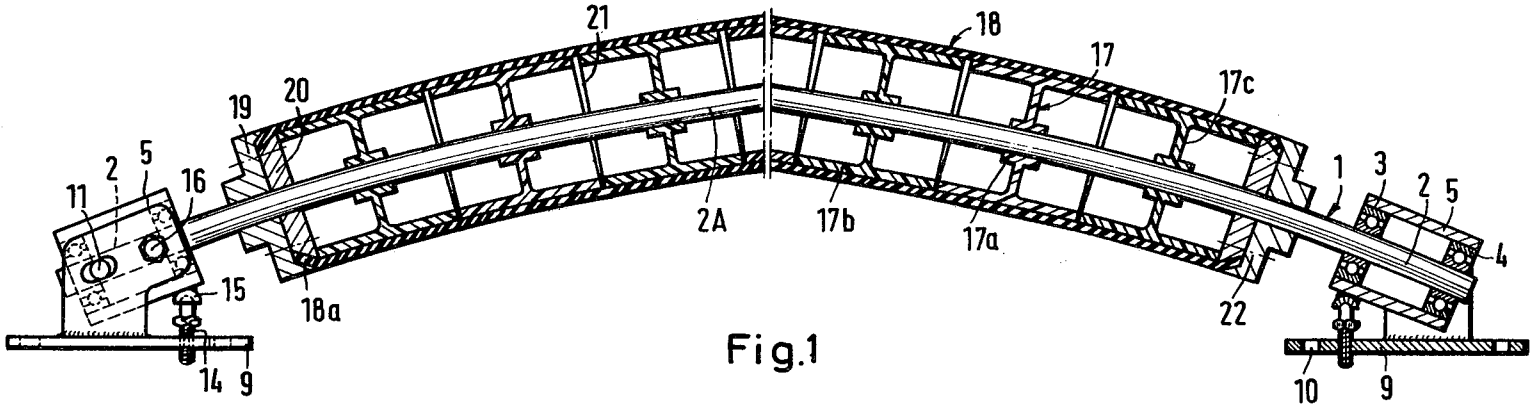
FIG. 1 is a fragmentary partly elevational and partly central longitudinal vertical sectional view of a spreader roll which embodies the invention.

The improved spreader roll comprises an elongated flexible arcuate shaft 1 whose end portions 2 are mounted in pairs of antifriction ball bearings 3 and 4. The outer races of each pair of bearings 3 and 4 are installed in sleeves 5 which are pivotable about axes 6 making a right angle with the respective end portions 2. The sleeves 5 are pivotable in pairs of parallel frame members or cheeks 7, 8 extending upwardly from base plates 9 which are formed with openings 10 for the shanks of bolts, screws or analogous fasteners (not shown) serving to secure the base plates to the frame of a textile machine or the like, not shown.

Each sleeve 5 includes two coaxial pivot members 11 which are located diametrically opposite each other, whose common axis coincides with the respective axis 6, and which extend into elongated slots 13 of the respective cheeks 7 or 8. Each pivot member extends radially outwardly from a substantially hemispherical protuberance 12 at the outer side of the respective sleeve 5. The protuberances 12 abut against the inner sides of the respective cheeks.

The orientation of sleeves 5 with respect to their stationary holders (such holders include the base plates 9 and the respective cheeks 7, 8) can be changed in two directions. The means for adjusting the orientation or inclination of sleeves 5 by pivoting them about the respective axes 6 comprises externally threaded adjusting members or screws 14 which mesh with internal threads of the respective base plates 9 and have hemispherical (convex) heads abutting against the undersides of the respective sleeves. As shown, the undersides of the sleeves 5 are formed with sockets 15 having concave internal surfaces for the heads of the respective adjusting screws 14.

The orientation of pivot members 11 on each sleeve 5 (i.e., the locus of a portion of or the entire pivot axis 6) can be changed by externally threaded adjusting members or screws 16 each of which is in mesh with an internally threaded portion (tapped bore) of one of the corresponding cheeks 7, 8 and abuts against one side of the respective sleeve. The axes of the adjusting screws 16 cross in space with and are normal to the axes of the associated adjusting screws 14. Adjustments which are effected by the screws 16 are made possible due to provision of elongated slots 13 for the pivot members 11. In the absence of excessive deviation of the curvature of shaft 1 from a normal curvature, the axes of the adjusting screws 14 and 16 intersect or nearly intersect the axis of the shaft 1.

The intermediate portion 2A of the shaft 1 carries a series of annular supporting elements 17 for a tubular envelope or hose 18 made of rubber or elastomeric synthetic plastic material. Each supporting element 17 has a hub **17*a* which is affixed to the portion 2A of the shaft 1, a cylindrical rim 17*b* which engages the internal surface of the adjacent portion of the hose 18, and a washer-like median portion or flange 17*c* which connects the hub 17*a* with the rim 17*b*. The washer-like median portions 17*c* can be replaced with median portions consisting of or including radially extending spokes. Due to curvature of the shaft 1, the neighboring supporting elements 17 define wedge-like gaps 21**.

The hose 18 surrounds all of the rims **17*b* and its open end portions 18*a* are airtightly clamped between pairs of clamping members 19 and 20. The members 20 are or resemble washers which are slipped onto the shaft 1 and abut against the rims 17*b* of the outermost supporting elements 17. The clamping members 19 resemble caps which overlie the respective end portions 18*a* and urge them against the adjacent surfaces of the clamping members 20. Screws, bolts or analogous fasteners 22 (indicated by phantom lines) are provided to attach each clamping member 19 to the associated clamping member 20. The clamping members 19, 20 completely seal the respective end portions 18*a* of the hose 18**.

The supporting elements 17 preferably consist of a suitable synthetic plastic material. The shaft 1 preferably also consists of a synthetic plastic material, most preferably of a material which is reinforced by fibers, e.g., glass fibers. Its flexibility must suffice to insure that the shaft 1 can rotate in the bearings 3, 4 when the spreader roll is in use. The supporting elements 17 are affixed to and rotate with the shaft 1.

The shaft 1 is rotated while it assumes and remains in the illustrated flexed condition. The means for rotating the shaft 1 in the bearings 3 and 4 is the web of textile material or paper which is trained over the elastic hose 18 and/or one or more belt drives or the like, not shown. The supporting elements 17 need not rotate relative to the shaft 1. This contributes to simplicity of the spreader roll and reduces the initial as well as maintenance cost. As mentioned above, heretofore known spreader rolls employ supporting elements each of which is mounted on one or more antifriction bearings. This not only increases the initial cost of the conventional spreader rolls but also necessitates complete dismantling if a supporting element and/or its bearing or bearings become defective, e.g., due to penetration of moisture into the interior of the hose. The hose 18, together with the clamping members 19 and 20 of the improved spreader roll, provides a fluidtight enclosure for the supporting elements 17.

Adjustments of the orientation of sleeves 5 and hence of the curvature and/or lateral deflection of the shaft 1 might be necessary in order to insure optimal spreading of a web of textile material or the like which contacts the external surface of the hose 18.

Figure 2:
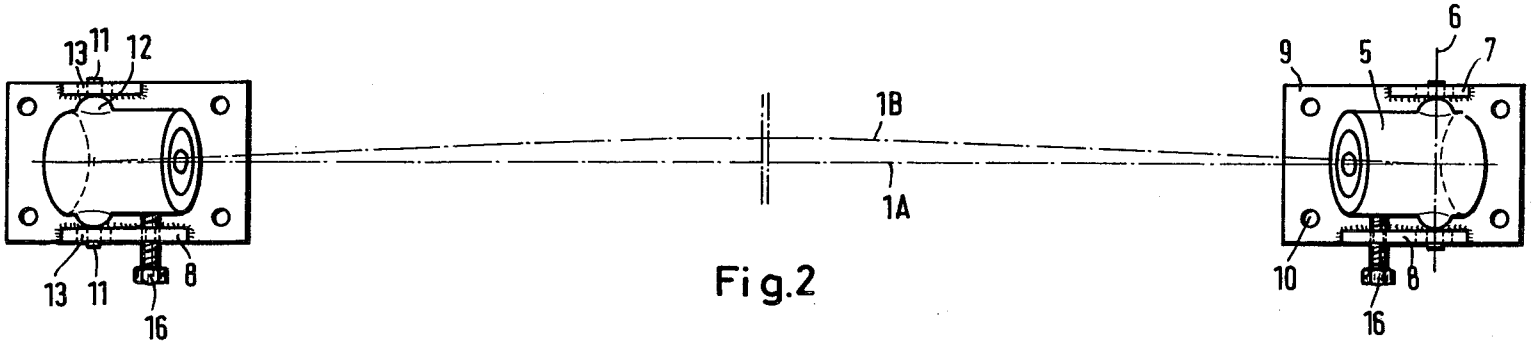
FIG. 2 is a plan view of the support means for the end portions of the flexible arcuate shaft in the spreader roll of FIG. 1.

The axis of the shaft 1 (in plan view), when such axis is intersected by the axes of adjusting screws 14, is indicated in FIG. 2 by the straight phantom line 1A. The line 1B denotes the axis of the shaft 1 (again in plan view) subsequent to lateral deflection by the adjusting screws 16.

An important advantage of the improved spreader roll is that the shaft 1 rotates with the supporting elements 17 and with the envelope or hose 18 relative to the holders 7–9 and sleeves 5 of the support means for its end portions 2. Each support means includes two bearings 3, 4, the respective sleeve 5, and one of the holders 7–9. The two support means flank the intermediate portion 2A which is located at a level above the end portions 2 of the shaft 1. The end portions 2 are or can be affixed to the inner races of the respective bearings 3 and 4; these bearings may constitute ball or roller bearings and the number of bearings for each end portion 2 can be reduced to one or increased to three or more.

Another important advantage of the improved spreader roll is that the end portions **18*a* of the hose 18 can be airtightly sealed in a simple and inexpensive way. However, prevention of penetration of any atmospheric air and moisture into the interior of the hose 18 is not absolutely necessary since the supporting elements 17** need not be mounted on antifriction bearings and can be made of a material (preferably a snythetic plastic substance) which can readily withstand corrosion. The maintenance cost of the improved spreader roll is only a small fraction, and its useful life is a multiple of the useful life of the aforedescribed conventional spreader rolls.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What I claim is:

1. In a spreader roll, the combination of an elongated arcuate flexible shaft having two end portions and an intermediate portion; support means rotatably mounting the end portions of said shaft, said support means including two sleeves, one for each end portion of said shaft and each rotatably receiving the respective end portion, and stationary holder means for each sleeve, said sleeves having pairs of coaxial pivot members disposed diametrically opposite each other and said holder means having elongated slots for the pivot members of the respective sleeves; a plurality of annular supporting elements surrounding and rotatable with the intermediate portion of said shaft; and means for adjusting the orientation of said shaft with respect to said support means, including pairs of mutually inclined adjusting members mounted in each holder means and operable to move the respective sleeves with respect to the associated holder means.

2. The combination of claim 1, wherein the intermediate portion of said shaft is disposed at a level above said end portions and one adjusting member of each pair of adjusting members is operable to change the inclination of the respective end portion and to thus change the curvature of said intermediate portion by turning the respective sleeve about the common axis of the pivot members.

3. The combination of claim 1, wherein the intermediate portion of said shaft is disposed at a level above said end portions and one adjusting member of each pair of adjusting members is operable to shift at least one pivot member of the respective sleeve in the corresponding slot of the associated holder means.

4. The combination of claim 1, wherein said adjusting members have external threads meshing with internal threads of the respective holder means and the axes of adjusting members of each pair of adjusting members make an angle of substantially 90 degrees.

5. The combination of claim 4, wherein the axes of said externally threaded adjusting members at least nearly intersect the axes of the respective end portions of said shaft.

6. The combination of claim 1, wherein each holder means comprises two substantially parallel frame members and said slots are provided in said frame members, each of said sleeves further having two substantially hemispherical external protuberances abutting against the frame members of the respective holder means, said pivot members being rigid with and extending outwardly from said protuberances.

* * * * *